US005082382A

United States Patent [19]

Negoro et al.

[11] Patent Number: 5,082,382

[45] Date of Patent: Jan. 21, 1992

[54] SHEET GUIDE MECHANISM FOR USE IN AN IMAGING DEVICE

[75] Inventors: Ikuo Negoro, Sakado; Kiyoshi Negishi, Tsurugashima; Masahiro Kita, Tokyo, all of Japan

[73] Assignee: Asahi Kogaku Kogyo K.K., Tokyo, Japan

[21] Appl. No.: 649,295

[22] Filed: Jan. 30, 1991

Related U.S. Application Data

[63] Continuation of Ser. No. 385,367, Jul. 27, 1989, abandoned.

[30] Foreign Application Priority Data

Jul. 29, 1988 [JP] Japan ..... 63-189866
Jun. 16, 1989 [JP] Japan ..... 1-153747

[51] Int. Cl.[5] ..... B41J 15/00
[52] U.S. Cl. ..... 400/613.2; 400/619
[58] Field of Search ..... 400/613.2, 613.3, 613.4, 400/619, 679, 680, 642, 646, 647, 647.1, 578; 248/918

[56] References Cited

U.S. PATENT DOCUMENTS 2,534,391 12/1950 Von Duyke ..... 400/80
4,696,591 9/1987 Boyden ..... 400/613.2
4,749,295 6/1988 Bankier et al. ..... 400/613.2

FOREIGN PATENT DOCUMENTS 2912883 10/1980 Fed. Rep. of Germany ... 400/613.2
3531420 3/1987 Fed. Rep. of Germany ... 400/613.2
120480 7/1984 Japan ..... 400/613.2
1147773 6/1966 United Kingdom .

*Primary Examiner*—Edgar S. Burr
*Assistant Examiner*—Ren Yan
*Attorney, Agent, or Firm*—Sandler, Greenblum, & Bernstein

[57] ABSTRACT

An appartaus utilizing a continuous-form sheet having a plurality of perforations at predetermined intervals of length is provided with a plate member for upwardly guiding the sheet discharged from the apparatus. A connect member provided on the plate member, as well as the apparatus, are arranged to be brought into and out of engagement with each other. The continuous-form sheet discharged from the apparatus is bent at the perforations and falls beyond the plate to be neatly folded.

8 Claims, 4 Drawing Sheets

SHEET GUIDE MECHANISM FOR USE IN AN IMAGING DEVICE

This application is a continuation of application Ser. No. 07/385,367, filed July 27, 1989, now abandoned.

BACKGROUND OF THE INVENTION

The present invention relates to a continuous-form sheet guide mechanism for a printer in which an image is formed on the continuous-form sheet, by the so-called electrophotographic processes and which is capable of being folded at a certain interval of length, and more particularly to a guide mechanism for controlling a direction along which the continuous-form sheet is discharged from the printer.

Imaging devices, such as laser printers have recently been widely used, in which a laser beam is modulated in accordance with graphics, characters and other image information is scanned on a surface of an electrically charged sensitized body (for example, photoconductive drum) for exposure to form a electrostatic latent images, and which is then developed to a visible image and transferred and fixed by a duplication processes (so-called electrophotographic processes), to thereby obtain a hard copy carrying image information on the continuous-form sheet. Small and inexpensive apparatuses using semiconductor lasers have been vigorously commercialized.

While such laser printers or the like image formation apparatuses sometimes use cut-sheet type recording sheets having a certain size, continuous-form sheet capable of being folded at a predetermined interval of length, so-called fan-folded sheet, is more often used to allow them to deliver hard copies with image information consecutively at a high speed. The fan-folded sheet is used as such continuous-form sheet. The fan-folded sheet has sprocket holes provided along a longitudinal direction at a certain interval of pitch on both sides of the sheet width, with a widthwise extending perforation at each folding line spaced by a certain interval of length with each other.

When using the continuous-form sheet, such as the fan-folded sheet, the continuous-form sheet is heated and pressed, i.e., thermally pressed by heat rollers as part of a fixing unit of the imaging devices. This causes folding lines at the perforations to tend to disappear, making folding operations difficult.

Since the folding lines of the continuous-form sheet are eliminated by the thermal press in the fixing process, causing trouble in the folding operations, the continuous-form sheet, that should have been stacked in a neatly folded state after being discharged from the imaging device, is likely to be placed in a sort of mess around a discharge outlet of the continuous-form sheet.

SUMMARY OF THE INVENTION

It is therefore an object of the present invention to provide an improved sheet guide mechanism having a function capable of easily and reliably folding a continuous-form sheet after being outputted from the thermal pressure process of an imaging device.

For this purpose, according to the invention, there is provided a sheet guide mechanism for an imaging device which employs a continuous form having a plurality of perforations at predetermined intervals of length along the longitudinal direction of said containuous form. The guide mechanism comprises a plate member that is vertically arranged at an outlet side of the imaging device to upwardly guide the continuous form discharged from the device.

With the arrangement as above, the continuous-form sheet discharged from the apparatus is guided toward a distant above point because the tray obliquely rises from the under part of the discharge outlet of the apparatus toward a distant point above. The paper is bent at the folding lines spaced at a certain interval of length by its own weight, falling upon a place beyond the tray to be folded there.

DESCRIPTION OF THE ACCOMPANYING DRAWINGS

DESCRIPTION OF THE EMBODIMENTS

The present invention will now be described with reference to the accompanying drawings.

Figure 1:
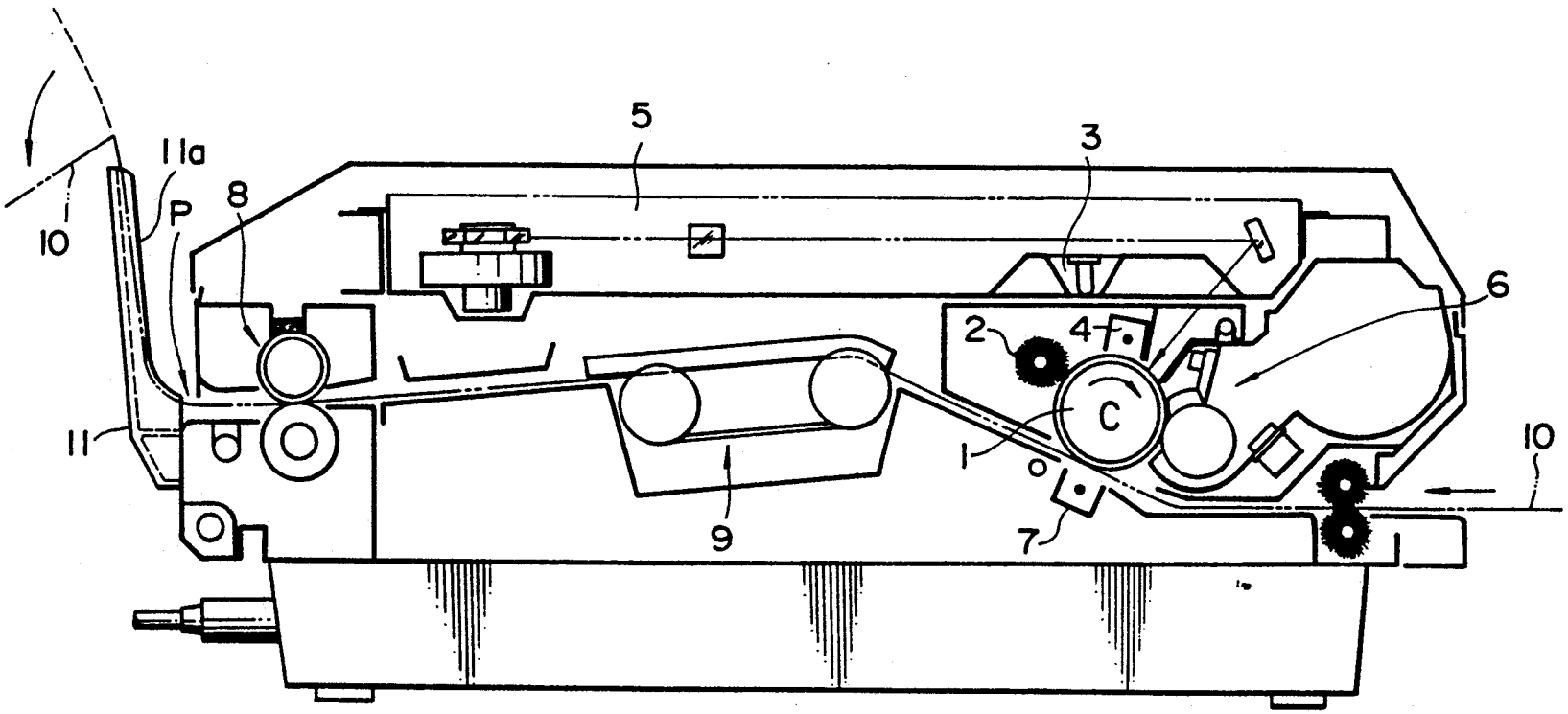
FIG. 1 is a side elevational view showing a general configuration of a laser printer incorporating a preferred embodiment of a sheet guide mechanism according to the present invention.
Figure 2:
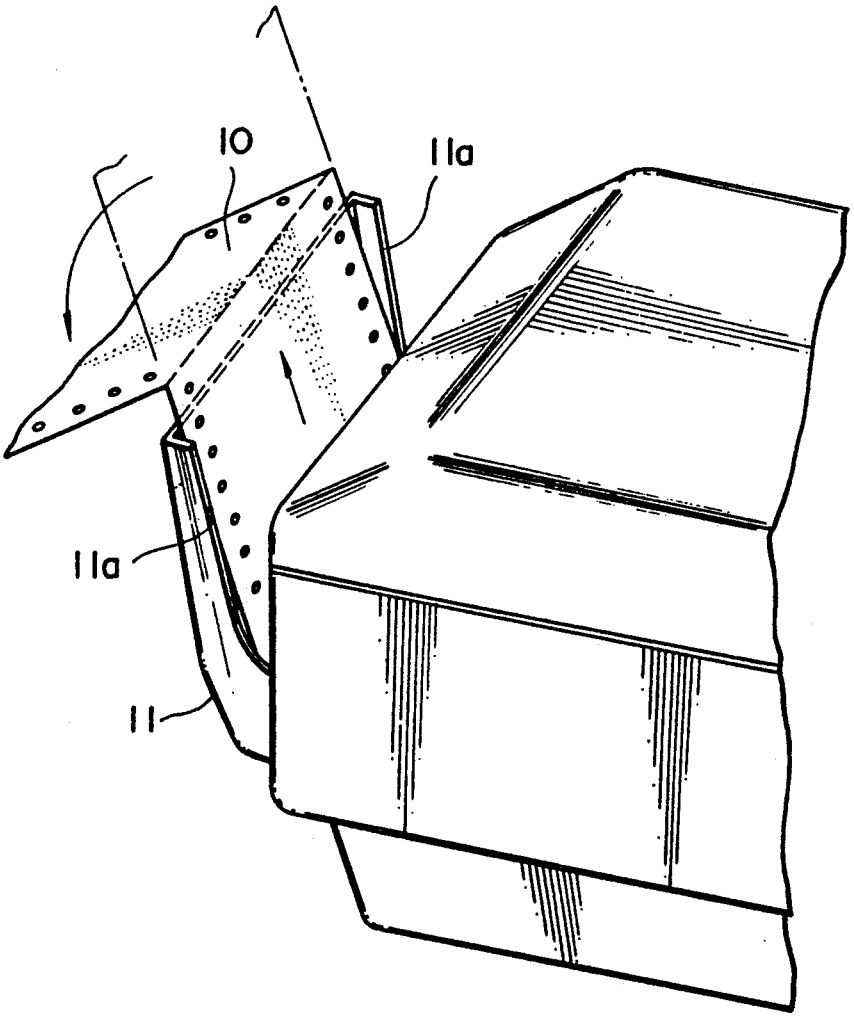
FIG. 2 is a partial perspective view showing a discharging operation of a continuous-form sheet in the laser printer shown in FIG. 1.

FIG. 1 is a side elevational view showing a general configuration of a laser printer incorporating a preferred embodiment of a sheet guide mechanism according to the present invention FIG. 2 is a partial perspective view showing a discharging operation of a continuous-form sheet in the laser printer shown in FIG. 1.

The laser printer prints out information, characters, numerals and the like corresponding to the codes stored in a host computer, or the like, on a continuous-form sheet 10 by means of the so-called electrophotographic processes.

Around a photoconductive drum 1 are a toner-cleaning station 2, a de-charging station 3, a charging station 4, an optical scanning system 5 for leading a laser beam modulated according to the input information onto a circumferential surface of the photoconductive drum 1, a developing station 6 and a transferring station 7 arranged in the aforementioned order in the rotational direction of the photoconductive drum 1 (as indicated by arrow "C"). A fixing station 8 is located in a predetermined position forward of a feeding direction of the continuous-form sheet 10. In the feed path for the continuous-form sheet 10 from the photoconductive drum 1 to the fixing station 8 is an inner guide mechanism 9 for guiding the continuous-form sheet 10 in a predetermined direction with resisting force applied to both ends of the continuous-form sheet 10 to appropriately control its transporting operation.

The surface of the photoconductive drum 1 is scanned by the laser beam emitted from the optical scanning system 5 in its longitudinal direction thereof (main scanning). While this main scanning is repeated, the photoconductive drum 1 is rotated in the direction indicated by the arrow "C" so that the surface thereof is scanned in a direction opposite to the rotation of the photoconductive drum 1 (auxiliary scanning). With this arrangement, the photoconductive drum 1 has with a latent image formed on its surface which is then developed to a visible image, (or toner image) by means of the developing station 6. Formation of a latent image and development thereof is thus accomplished by the so-called electrophotographic processes. The aforementioned toner image is then tranferred from the photoconductive drum 1 to the surface of the continuous-form sheet 10. After fixing the transferred toner image by means of the fixing station 8, the continuous-form sheet 10 is discharged through sheet outlet "P".

The surface of the photoconductive drum 1 is cleaned by the toner-cleaning station 2 before each scanning (latent image formation) to remove the residual toner of the previous process, and is then electrically charged by the charge station 4 across the whole area thereof.

The continuous-form sheet 10 comprises a continuous form which is to be folded at a predetermined interval of length. Consecutive sprocket holes are formed on both edges of the sheet at a ceratin pitch. The folding line at which the sheet is folded at a predetermined interval has perforations to facilitate separating one section of the sheet from another. The paper sections are thus torn apart after the continuous printing to be put into a record file.

Proximate the sheet outlet "P" for the continuous-form sheet 10 is a guide tray 11 for controlling the direction in which the continuous-form sheet 10 is discharged. The guide tray 11 has a width that is a little greater than the width of the continuous-form sheet 10. Side 11*a* and 11*b* of the guide tray 11 are bent in the same direction so as to be perpendicular to a base portion 11*s*. The bent portions of the sides 11*a* and 11*b* are arranged in opposition to the sheet outlet "P". One end of the tray is fixedly engaged with the underside of the outlet "P" so that the tray rises from the sheet outlet "P" obliquely toward some distant remote point.

With this arrangement, since the guide tray 11 rises from the underside of the sheet outlet "P" toward some remote point above, the continuous-form sheet 10 discharged from the sheet outlet "P" is guided toward the remote point above and at a point where it leaves a top edge of the guide tray 11, and is downward bent by its weight at the perforation with a folding line to be folded at a certain interval. Thus, the sheet falls upon a place beyond the tray 11 in a neatly folded state. Since the continuous-form sheet 10 is weakened at its perforations than at other parts of sheet, the sheet guided by the upwardly projecting tray yields to its own weight so as to be always bent at the perforations. Even when the folding line at the perforation is eliminated by the heat press in the fixing process with the fixing station 8, making folding at the perforated line difficult, the lower rigidity at the perforation than in other parts is maintained, so that the sheet is always bent at the perforations. This allows the sheet to fall on a place beyond the guide tray 11 in a neatly folded condition.

The continuous-form sheet 10 is vibrated when it falls, as described above, beyond the guide tray 11. This vibration propagates to the sheet section of the continuous-form sheet 10 that has already fallen beyond the guide tray 11. Such vibration of the continuous-form sheet 10 that has fallen beyond the guide tray 11 promotes its folding operation to further help it be neatly folded.

The continuous-form sheet 10 is thus always bent at the perforation and is neatly folded by means of s simple structure comprising a guide tray 11 provided at the paper outlet "P".

Another embodiment of the guide tray 11 will be described below with reference to FIG. 3 and FIG. 4.

Figure 3A:
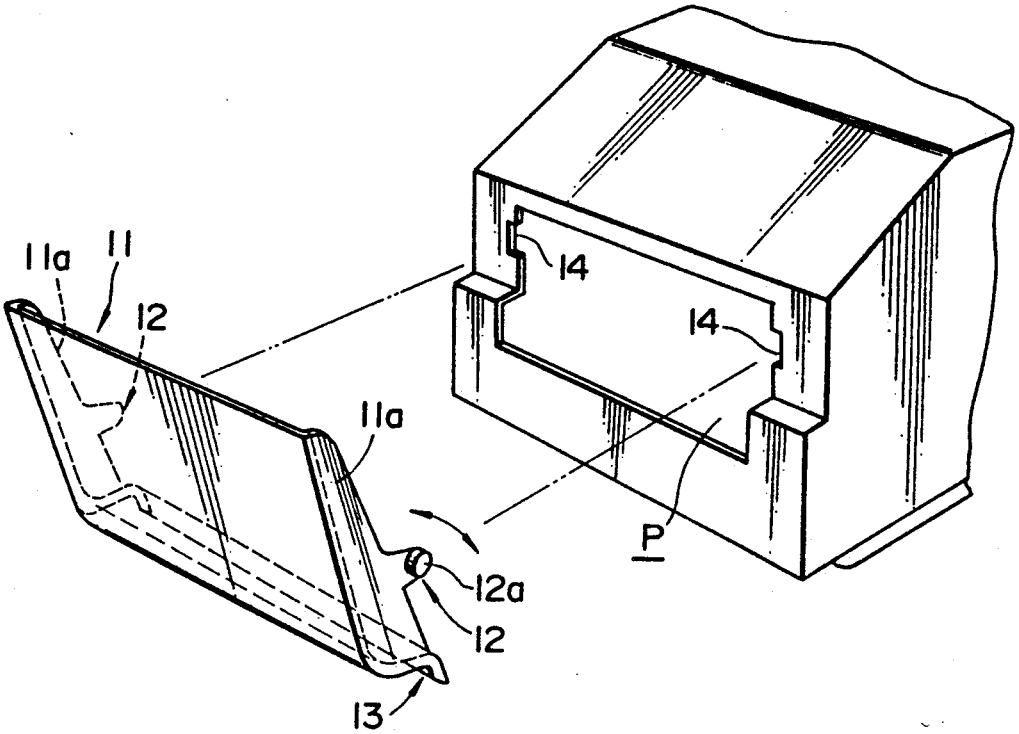
FIG. 3(A) is a disassembled perspective view of a second embodiment of the present invention.

The guide tray 11 is, as shown in FIG. 3(A), provided at each side portion 11*a* or 11*b* with which it is mounted on the laser beam printer with a mounting projection 12 having a predetermined width, which has integrally formed therewith an engagement projection 12*a* at an outer leading end thereof. The bottom edge of the guide tray 11 extends downward to provided an enagagement hook 13.

The opening portion for installation i.e., the sheet outlet "P", through which the guide tray 11 is mounted on the laser beam printer has at each of its lateral edges an engagement section 14 that is formed to enable engagement with the engagement projection 12*a* by a resilient deformation of the mounting projection 12.

The hook 13 of the guide tray 11 is inserted into the opening portion (sheet outlet "P") and is hooked on its bottom edge, with the engagement projection 12 pushed into the opening portion through the engagement section 14. The mounting projection 12 then yields to be deformed, allowing the engagement projection 12*a* to be fully placed in the printer body. After this, the mounting projection 12 is restored from its deformation, whereby the guide tray 11 is engaged and installed in position as shown in FIG. 3(B).

Figure 3B:
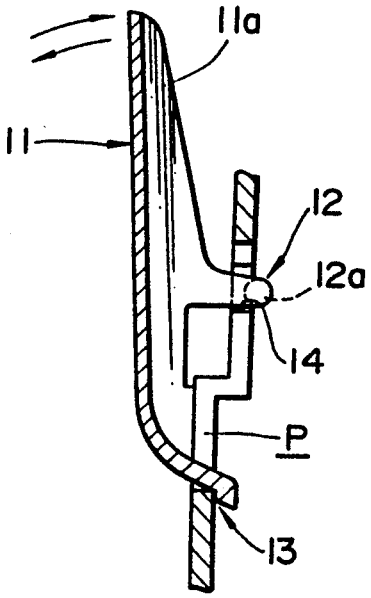
FIG. 3(B) is a vertical sectional view when the guide mechanism is mounted.

According to this arrangement, when an excessive force is inadvertently applied to the upwardly projecting guide tray 11 in an arrow-indicated shown in FIG. 3B, the guide tray 11 slips out of the engagement 14 with no damage to the guide tray 11.

Figure 4A:
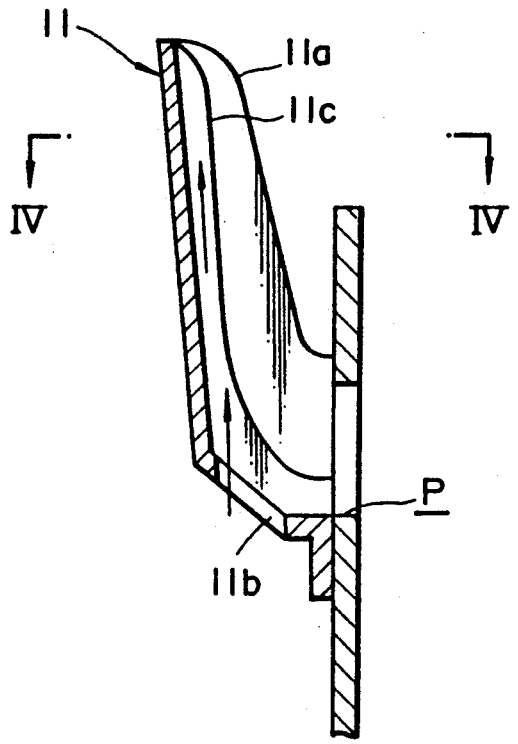
FIG. 4(A) is a illustrative view of a third embodiment of the present invention.
Figure 4B:
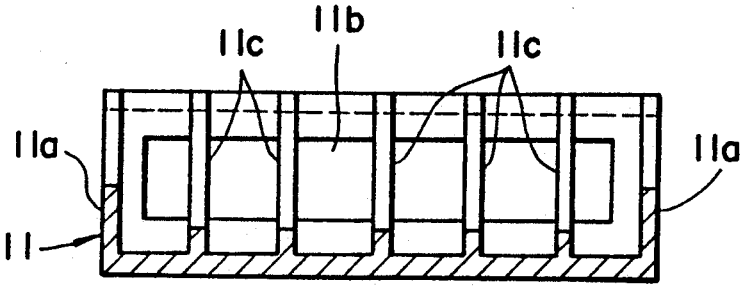
FIG. 4(B) is sectional view taken along a line IV—IV of FIG. 4(A).

Illustrated in FIGS. 4A and 4B are opening portions 11*d* formed at the bottom of the guide tray 11 and a plurality of rib portions 11*e* formed on the inside surface of the guide tray 11 (the surface, along which the continuous-form sheet 10 is discharged from the printer body is guided in contact therewith). The continuous-form sheet 10 is thus guided along the top edges of the ribs 11*e*.

With this arrangement, the continuous-form sheet 10 is heated to a high temperature for thermal fixing in the fixing station 8 and is rapidly cooled by the air flowing in the direction indicated by an arrow in the to thereby quickly finish the fixing process (i.e., cooling the continuous-form sheet 10 and solidifying a toner to be fixed on the surface of the continuous-form sheet 10) while also preventing curling of the continuous-form sheet 10.

What is claimed is:

1. A sheet guide mechanism for an imaging device which employs a continuous form having a plurality of transverse perforations at predetermined intervals of length along a longitudinal direction of said continuous form so as to divide said continuous form into a plurality of sheets, comprising a plate member that is vertically arranged at an outlet side of said imaging device to upwardly guide said continuous form that is discharged from said device, said continuous form passing over a top edge of said plate member so that the weight of said continuous paper causes said continuous form to be bent downward, causing said continuous form to be folded into a predetermined arrangement that is defined by the placement of said transverse perforations, which further comprises an install member including a first connect member provided on said plate member and a second connect member provided on said sheet guide mechanism which are adapted to be brought into and out of engagement with each other.

2. A sheet guide mechanism for an imaging device which employs a continuous form having a plurality of transverse perforations at predetermined intervals of length along a longitudinal direction of said continuous form, comprising:

a plate member that is arranged at an outlet side of said imaging device to upwardly guide said continuous form that is discharged from said device, said plate member having a bottom edge and side edges;

a first connect member provided on said plate member;

a second connect member provided on said sheet guide mechanism, said first and second connect members being adapted to be brought into and out of engagement with each other, wherein said first connect member comprises mounting projections provided at predetermined positions of said side edges of said plate member, said mounting projections being integrally formed with said first connect member, a hook portion being formed at said bottom edge of said plate member, said second connect member comprising engagement portions provided on said sheet guide mechanism that are adapted to be brought into and out of engagement with said projection portion and said hook portion.

3. A sheet guide mechanism for an imaging device which employs a continuous form having a plurality of transverse perforations at predetermined intervals of length along a longitudinal direction of said continuous form, comprising:

a plate member that is positioned at an outlet side of said imaging device to upwardly guide said continuous form that is discharged from said device;

a first connect member that is provided on said plate member; and a second connect member that is provided on said imaging device and which is adapted to be brought into and out of engagement with said first connect member, wherein when a predetermined length of said continuous form passes over a top edge of said plate member, the weight of said continuous paper causes said continuous form to be bent downward and away from said outlet side of said imaging device, resulting in said continuous form being folded into a predetermined arrangement that is defined by the placement of said transverse perforations in said continuous form.

4. A sheet guide mechanism for an imaging device which employs a continuous form having a plurality of transverse perforations at predetermined intervals of length along a longitudinal direction of said continuous form, comprising:

an upwardly extending plate member positioned at an outlet side of said imaging device to upwardly guide said continuous form discharged from said device, said plate member having a plurality of open portions;

a projection portion provided at a predetermined position of an edge of said plate member, said plate member having said projection portion integrally formed therewith; and an engagement portion provided on said device that is adapted to be brought into and out of engagement with said projection portion, wherein said continuous form passes over a top edge of said plate member and is bent downward and away from said outlet side of said imaging device along one of said plurality of transverse perforations by the weight of said continuous form so that said continuous form is folded into prearranged intervals as defined by the placement of said plurality of transverse perforations in said continuous form.

5. A sheet guide mechanism for an imaging device which employs a continuous form having a plurality of transverse perforations at predetermined intervals of length along a longtiudinal direction of said continuous form, comprising:

a plate member having a bottom edge and a top edge, said bottom edge being attached to an outlet side of said imaging device such that said plate member is positioned to extend upwardly, said top edge being spaced apart from said bottom edge by a predetermined distance, said plate member operating to guide said continuous form discharged from said imaging device over said top edge of said plate member away from said outlet side of said imaging device, said continuous form being bent down over said top edge of said plate member due to the weight of said continuous form, folding said continuous form into said predetermined intervals of length;

a first connect member that is provided on said plate member; and a second connect member that is provided on said device which is adapted to be brought into and out of engagement with said first connect member.

6. The sheet guide mechanism of claim 5, further comprising a plurality of opening portions provided on said plate member.

7. The sheet guide mechanism of claim 6, wherein said opening portions are provided at a predetermined area of a bottom side edge of said guide member.

8. A sheet guide mechanism for an imaging device which employs a continuous form having a plurality of tranverse perforations at predetermined intervals of length along a longitudinal direction of said continuous form, comprising:

a plate member having a bottom edge, a top edge and a plurality of open portions, said top edge being spaced apart from said bottom edge by a predetermined distance, said bottom edge being positioned proximate an outlet side of said imaging device and being positioned such that said plate member is angled upward, said plate member guiding said continuous form that is discharged from said imaging device over said top edge of said plate member away from said outlet side of said imaging device, said continuous form bending down over said top edge of said plate member due to the weight of said continuous form, folding said continuous form along said perforations formed in said continuous form;

a projection portion provided at a predetermined position of an edge of said plate member, said plate member having said projection portion integrally formed therewith; and an engagement portion provided on said device that is adapted to be brought into and out of engagement with said projection portion.

* * * * *

UNITED STATES PATENT AND TRADEMARK OFFICE

CERTIFICATE OF CORRECTION

PATENT NO. : 5,082,382

DATED : January 21, 1992

INVENTOR(S) : I. NEGORO et al.

It is certified that error appears in the above-indentified patent and that said Letters Patent is hereby corrected as shown below:

At column 6, line 41 (claim 8, line 3), change "tranverse" to ---transverse---.

Signed and Sealed this

Twenty-sixth Day of April, 1994

*Attest:*

*Attesting Officer*

Bruce Lehman

BRUCE LEHMAN

*Commissioner of Patents and Trademarks*